US009248691B2

(12) United States Patent
Chen

(10) Patent No.: US 9,248,691 B2
(45) Date of Patent: Feb. 2, 2016

(54) ADJUSTABLE PENCIL SHARPENER

(71) Applicant: SDI Corporation, Chang Hua, TN (US)

(72) Inventor: Szu-Yu Chen, Chang Hua (TW)

(73) Assignee: SDI Corporation, Chang Hua (TW)

( * ) Notice: Subject to any disclaimer, the term of this patent is extended or adjusted under 35 U.S.C. 154(b) by 309 days.

(21) Appl. No.: 13/792,893

(22) Filed: Mar. 11, 2013

(65) Prior Publication Data

US 2014/0000119 A1 Jan. 2, 2014

(30) Foreign Application Priority Data

Jun. 29, 2012 (TW) ..... 101212581 U

(51) Int. Cl.
*B43L 23/08* (2006.01)
*B43L 23/04* (2006.01)

(52) U.S. Cl.
CPC ..... *B43L 23/08* (2013.01); *B43L 23/085* (2013.01); *B43L 23/04* (2013.01)

(58) Field of Classification Search
CPC ..... B43L 23/08; B43L 28/085
USPC ..... 30/451–462; 74/553, 556
See application file for complete search history.

(56) References Cited

U.S. PATENT DOCUMENTS 6,397,480 B1 * 6/2002 Mak et al. ..... 30/457

FOREIGN PATENT DOCUMENTS

| | | | |
|---|---|---|---|
| CN | 2517593 Y | * | 10/2002 |
| CN | 201573462 U | | 9/2010 |
| DE | 3737863 C1 | | 8/1988 |
| GB | 2289445 A | | 11/1995 |
| JP | 2001322391 A | * | 11/2001 |
| JP | 2003154791 A | | 5/2003 |
| TW | M384109 | | 7/2010 |

OTHER PUBLICATIONS

European Patent Office, Extended European Search Report for EPC Application No. EP13161127.9.
Australian Patent Office, Australian Examination Report No. 1 for AU Application No. AU2013202169, dated Nov. 1, 2013, 5 pages.

* cited by examiner

*Primary Examiner* — Ned Landrum
*Assistant Examiner* — Liang Dong
(74) *Attorney, Agent, or Firm* — C. G. Mersereau; Nikolai & Mersereau, P.A.

(57) ABSTRACT

A pencil sharpener has a waste case, a blade base, a blocking chunk, a blade, a rotating knob and an adjusting shaft. The waste case has a mounting hole and multiple positioning segments formed on the inner wall of the mounting hole. The blocking chunk is moveably mounted on the bottom of the blade base along an axial direction of the blade base. The blade is mounted securely on the blade base. The rotating knob is mounted rotatably in the mounting hole in the waste case and has at least one engaging segment selectively engaging the positioning segments of the waste case. The adjusting shaft is connected securely with the rotating knob and is disposed on the blocking chunk. When the rotating knob is rotated, the adjusting shaft is rotated to push the blocking chunk to move along the axial direction of the blade base.

16 Claims, 8 Drawing Sheets

ADJUSTABLE PENCIL SHARPENER

BACKGROUND OF THE INVENTION

1. Field of the Invention

The present invention relates to a pencil sharpener, and more particularly to an adjustable pencil sharpener having capabilities of adjusting degrees of sharpness of a pencil tip and providing a user with a clear signal when the adjusting process is completed.

2. Description of Related Art

A pencil sharpener can sharpen a pencil to expose and sharpen the pencil core for writing. To fit with different needs, an adjustable pencil sharpener is provided to adjust degrees of sharpness of pencil tips. With reference to FIG. 7, a conventional pencil sharpener disclosed in Taiwan Utility Model No. M384109, entitled "Pencil Lead Sharpener Having Two Operation Stages", comprises a waste case 70, a first blade base 71, a second blade base 72, a cam 73 and a rotating board 74. The first blade base 71, the second blade base 72 and the cam 73 are mounted in the waste case 70. The second blade base 72 is mounted on and axially moveable relative to a bottom of the first blade base 71. The cam 73 has multiple pushing protrusions 731 in different longitudinal heights formed on and protruding from a top of the cam 73, and the second blade base 72 has a bottom abutting one of the pushing protrusions 731 on the cam 73. The rotating board 74 is mounted on and exposed from a bottom of the waste case 70 and is connected with the cam 73. When the rotating board 74 is rotated, the cam 73 can be rotated to push the second blade base 72 to move axially relative to the first blade base 71. Accordingly, the relative axial distance between the first and second blade bases 71,72 can be changed, and the tip of the pencil can be sharpened into varying degrees of sharpness.

However, the conventional pencil sharpener has the following drawback. When the rotating board 74 is rotating to adjust the sharpness of the pencil tips, the conventional pencil sharpener cannot provide the user with a clear feedback signal to show that the adjusting process is completed by positioning the blade bases 71,72. The rotating board 74 may be over-rotated or the user gests confused about the direction in which the rotating board 74 should be rotated, so the conventional pencil sharpener is inconvenient in use.

To overcome the shortcomings, the present invention tends to provide a pencil sharpener to mitigate or obviate the aforementioned problems.

SUMMARY OF THE INVENTION

The main objective of the invention is to provide an adjustable pencil sharpener that can adjust the degree of sharpness of a pencil tip. With the engagement between at least one engaging segment on a rotating knob and positioning segments on a waste case, vibrations and sounds will be generated to provide users with a clear feedback signal that the adjusting process is completed.

To achieve the aforementioned objective, the pencil sharpener of the present invention has a waste case, a blade base, a blocking chunk, a blade, a rotating knob and an adjusting shaft. The waste case has a mounting hole and multiple positioning segments. The mounting hole is defined in the waste case and has an inner wall. The positioning segments are formed on the inner wall of the mounting hole. The blade base is mounted in the waste case and has a bottom. The blocking chunk is moveably mounted on the bottom of the blade base along an axial direction of the blade base and has a bottom. The blade is mounted securely on the blade base. The rotating knob is mounted rotatably in the mounting hole in the waste case and has at least one engaging segment selectively engaging the positioning segments of the waste case. The adjusting shaft is connected securely with the rotating knob, is disposed on the bottom of the blocking chunk and abuts a bottom of the blocking chunk. When the rotating knob is rotated, the adjusting shaft is rotated to push the blocking chunk to move along the axial direction.

With the pencil sharpener in accordance with the present invention, the axial position of the blocking chunk relative to the blade base can be changed by means of rotating the rotating knob to rotate the adjusting shaft. Thus, different sharpening effects can be applied to a sharpened pencil. With the vibrations and sounds generated by the engagement between the at least one engaging segment of the rotating knob and the positioning segments of the waste case, a clear feedback signal that the adjusting process is completed is provided to a user. Accordingly, the sharpening condition of the pencil tip, such as the degrees of bluntness or sharpness can be actually controlled and recognized.

Other objects, advantages and novel features of the invention will become more apparent from the following detailed description when taken in conjunction with the accompanying drawings.

DETAILED DESCRIPTION OF PREFERRED EMBODIMENT

Figure 1:
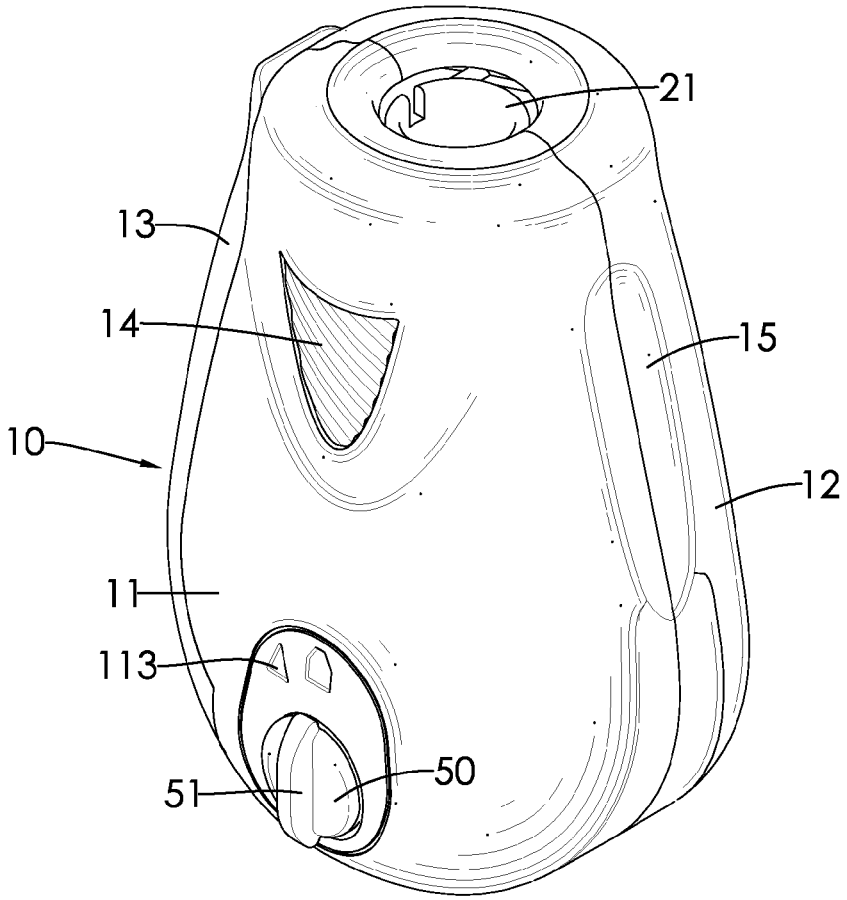
FIG. 1 is a perspective view of a pencil sharpener in accordance with the present invention.

With reference to FIGS. 1 to 4, a pencil sharpener in accordance with the present invention comprises a waste case 10, a blade base 20, a blocking chunk 30, a blade 40, a rotating knob 50 and an adjusting shaft 60.

The waste case 10 is flat, egg-shaped and hollow and comprises a front casing 11, a rear casing 12 and a side cover 13. The front casing 11 has a mounting hole 111, multiple indication members 113, a combining segment 114 and a skid-proof segment 14. The mounting hole 111 is defined through the front casing 11 at a position near the bottom of the front casing 11. The mounting hole 111 has an inner wall and multiple positioning segments 112 formed on the inner wall of the mounting hole 111 and arranged in a circle. The indication members 113 are disposed on an outer surface of the front casing 11, are arranged around the mounting hole 111 and respectively have a shape corresponding to a sharpening effect, such as a sharp tip or a blunt tip. The combining segment 114 is disposed on an inner surface of the front casing 11. The skid-proof segment 14 is shaped as an inverted triangle and is formed on the outer surface near a top of the front casing 11. The rear casing 12 is combined with the front casing 11 and comprises a combining segment 121, a limiting recess 122 and a skid-proof segment 14. The combining segment 121 is formed on an inner surface of the rear casing 12 and is combined with the combining segment 114 of the front casing 11 so as to combine the front and rear casings 11,12 together. The limiting recess 122 is defined in the inner surface near a bottom of the rear casing 12 and has two end walls respectively on two ends of the limiting recess 122. The skid-proof segment 14 is shaped as an inverted triangle, is formed on the outer surface near a top of the rear casing 12 and corresponds to the skid-proof segment 14 of the front casing 11 in position. In addition, the waste case 10 further has a top opening, a side recess 15 and a side opening. The top opening is defined in a top of the waste case 10 and at the conjunction between the front and rear casings 11,12. The side recess 15 is elongated and is defined at the conjunction between the front and rear casings 11,12 in a side of the waste case 10. With the arrangement of the side recess 15, the waste case 10 can be conveniently held in a hand of a user. The side opening is defined at the conjunction between the front and rear casings 11,12 in a side of the waste case 10 opposite to the side recess 15. The side cover 13 is pivotally connected to the front casing 11 and the rear casing 12 at a position near the side opening to cover the side opening. When the side cover 13 is pivoted and opened relative to the side opening, the scraps collected in the waste case 10 can be released from the side opening. Preferably, the side cover 13 has a pivoting sleeve 131 disposed on a bottom of the side cover 13. Each one of the front and rear casings 11,12 has a pivotal post formed on the inner surface near the bottom of the casing 11,12 at a position adjacent to the side opening. Two ends of the pivoting sleeve 131 are mounted respectively around the pivotal posts on the front and rear casings 11,12, such that the side cover 13 is pivotally connected with the front and rear casings 11,12.

The blade base 20 is mounted in the waste case 10 and has a pencil inserting hole 21 and a limiting collar 22. The pencil inserting hole 21 is defined longitudinally through the blade base 20 and corresponds to the top opening of the waste case 10. The limiting collar 22 is formed on and protrudes from a bottom of the blade base 20 and communicates with a bottom end of the pencil inserting hole 21. The limiting collar 22 has a center aligned axially with a center of the pencil inserting hole 21. In addition, the limiting collar 22 has a gap defined in the limiting collar 22.

The blocking chunk 30 is moveably mounted through the limiting collar 22 on the blade base 20 along an axial direction of the blade base 20. The blocking chunk 30 has a middle, a bottom and two ends, and the diameter of the middle is smaller than that of the ends. In a preferred embodiment, the middle of the blocking chunk 30 can pass through the gap in the limiting collar 22 to dispose the blocking chunk 30 into the limiting collar 22.

The blade 40 is mounted securely on a side of the blade base 20 and has a cutting edge extending into the pencil inserting hole 21.

The rotating knob 50 is mounted rotatably on the waste case 10 through the mounting hole 111 and comprises a front side, a rear side, an operating rib 51, an engaging recess 52 and at least one connecting tab 53. The operating rib 51 is formed on the front side of the rotating knob 50, is exposed from the outer surface of the waste case 10 and selectively corresponds to one of the indication members 113 on the waste case 10. The engaging recess 52 is non-circular in shape and is formed in the rear side at the center of the rotating knob 50. The at least one connecting tab 53 is formed on and protrudes from the rear side of the rotating knob 50 and is arranged around the engaging recess 52. Each one of the at least one connecting tab 53 is resilient and has a free end, a holding block 531 and an engaging segment 532. The holding block 531 is formed on and protrudes outward from the free end of the connecting tab 53. The engaging segment 532 is formed on an outer surface of the connecting tab 53. The at least one connecting tab 53 is mounted rotatably through the mounting hole 111 in the waste case 10, and the holding block 531 of each one of the at least one connecting tab 53 engages an edge of the mounting hole 111 in the waste case 10. Accordingly, the rotating knob 50 is mounted rotatably on the waste case 10. In addition, the engaging segment 532 on each one of the at least one connecting tab 53 selectively engages one of the positioning segments 112 in the mounting hole 111. When the engaging segment 532 is disengaged from the corresponding one of the positioning segments 112 and enters into the other one of the positioning segments 112, vibrations and sounds will be generated.

Figure 2:
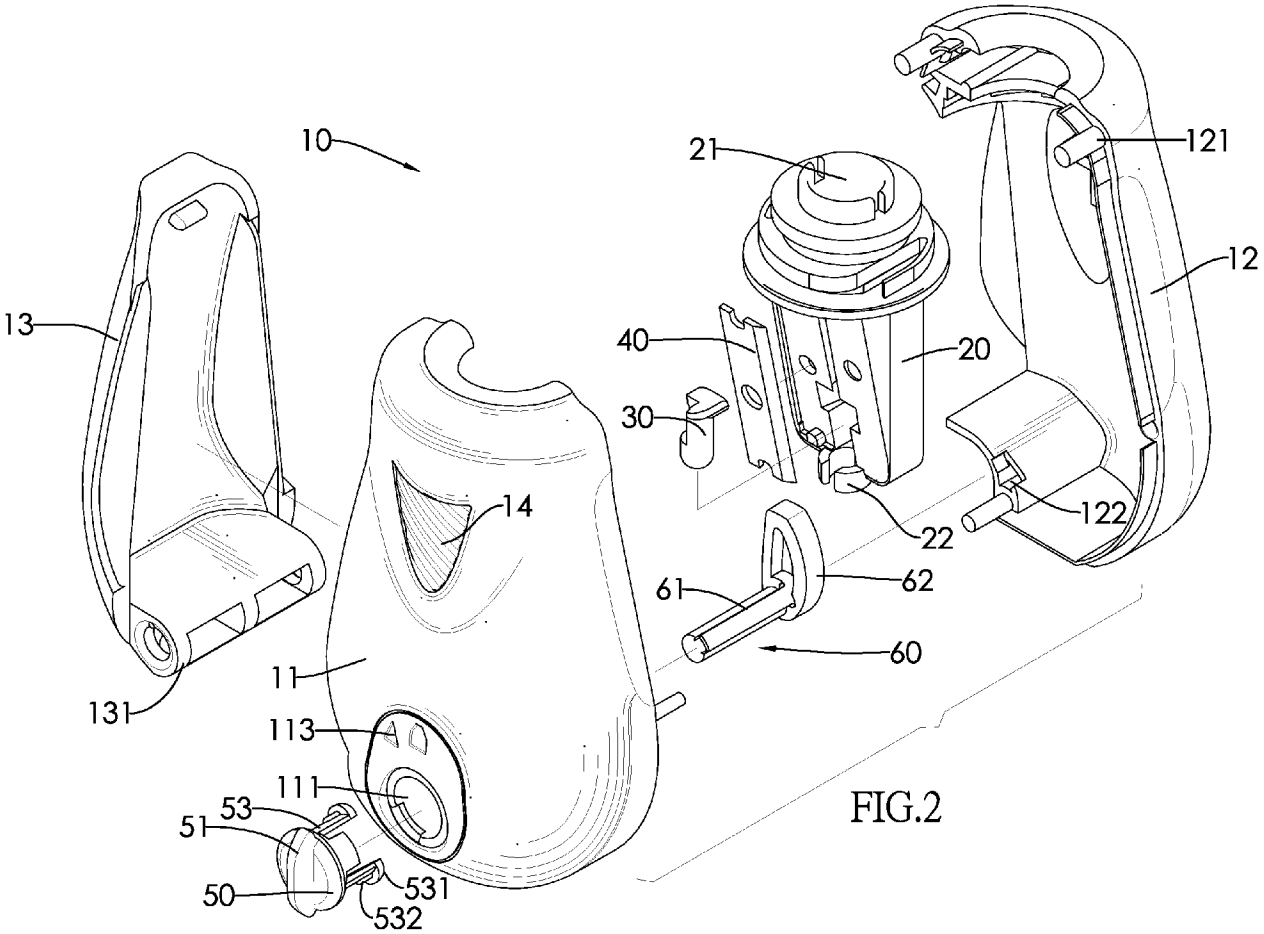
FIG. 2 is an exploded perspective view of the pencil sharpener in FIG. 1.
Figure 2A:
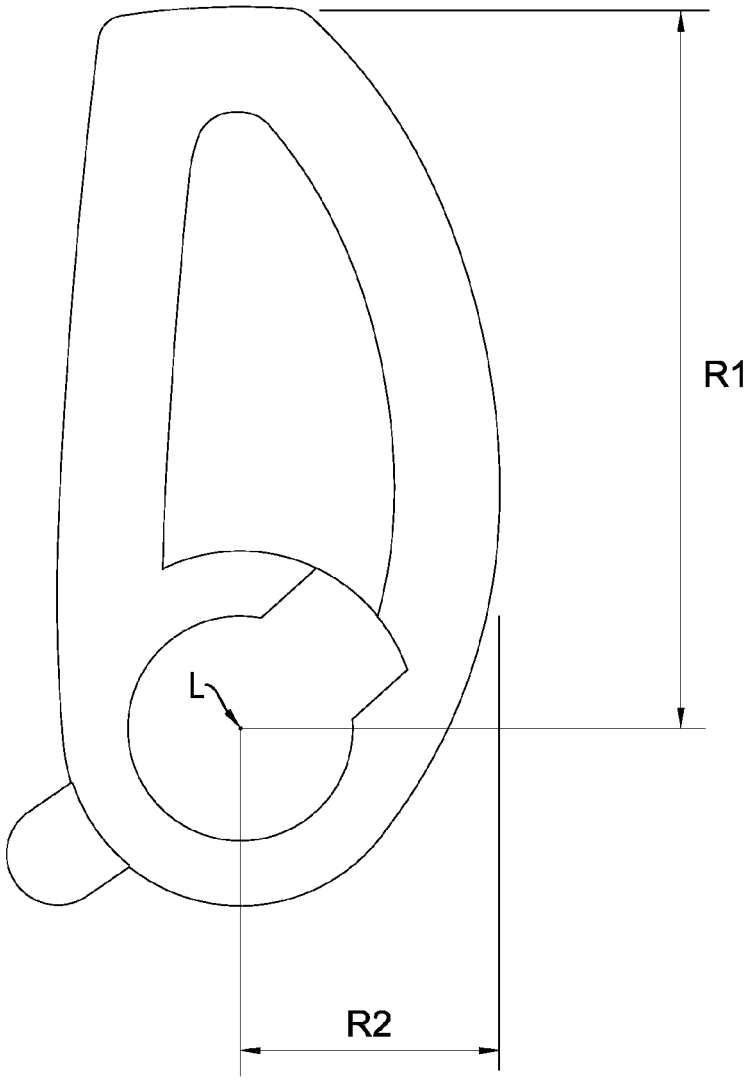
FIG. 2A is an enlarged end view of the adjusting shaft of the pencil sharpener in FIG. 2.
Figure 3:
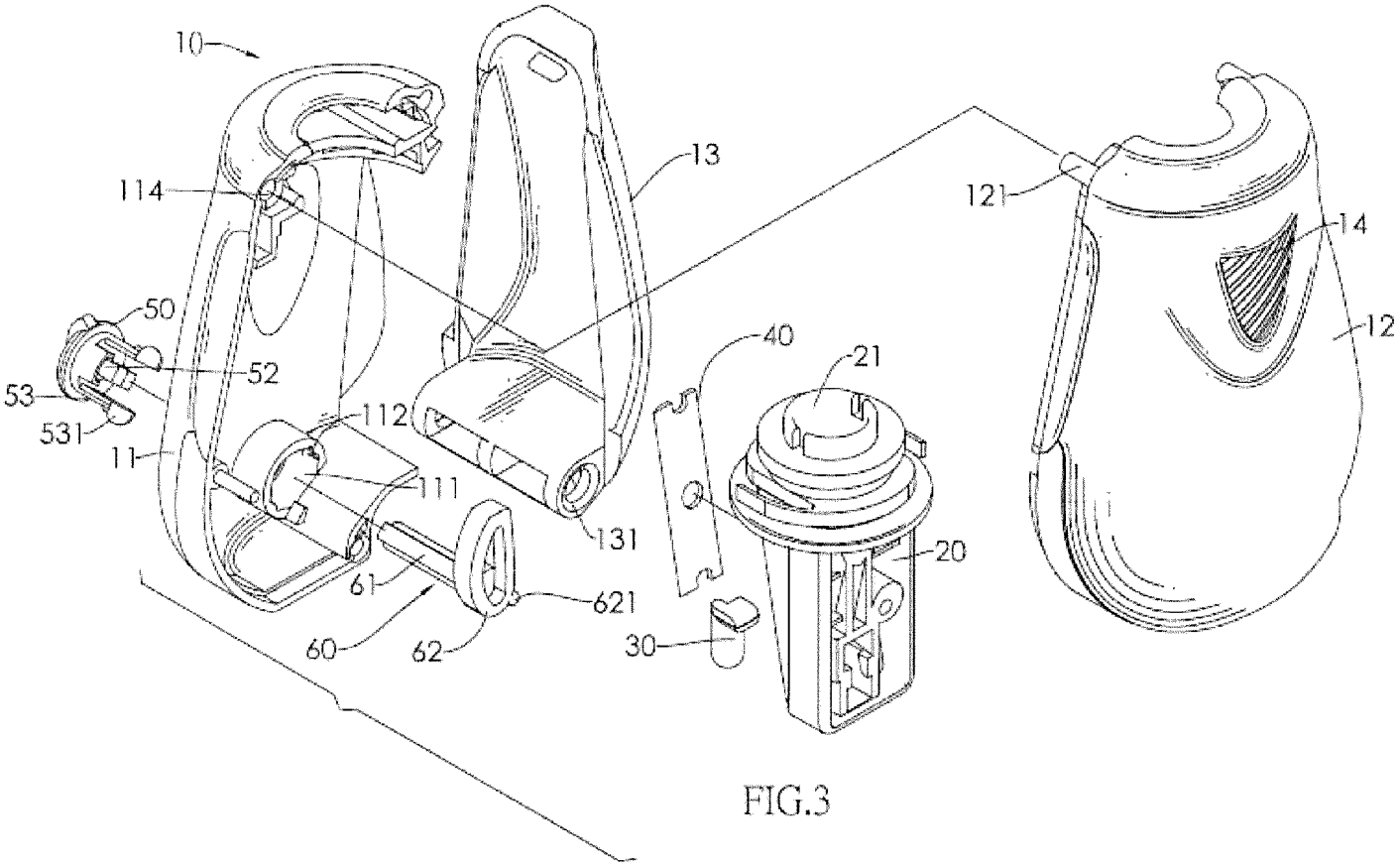
FIG. 3 is another exploded perspective view of the pencil sharpener in FIG. 1.
Figure 4:
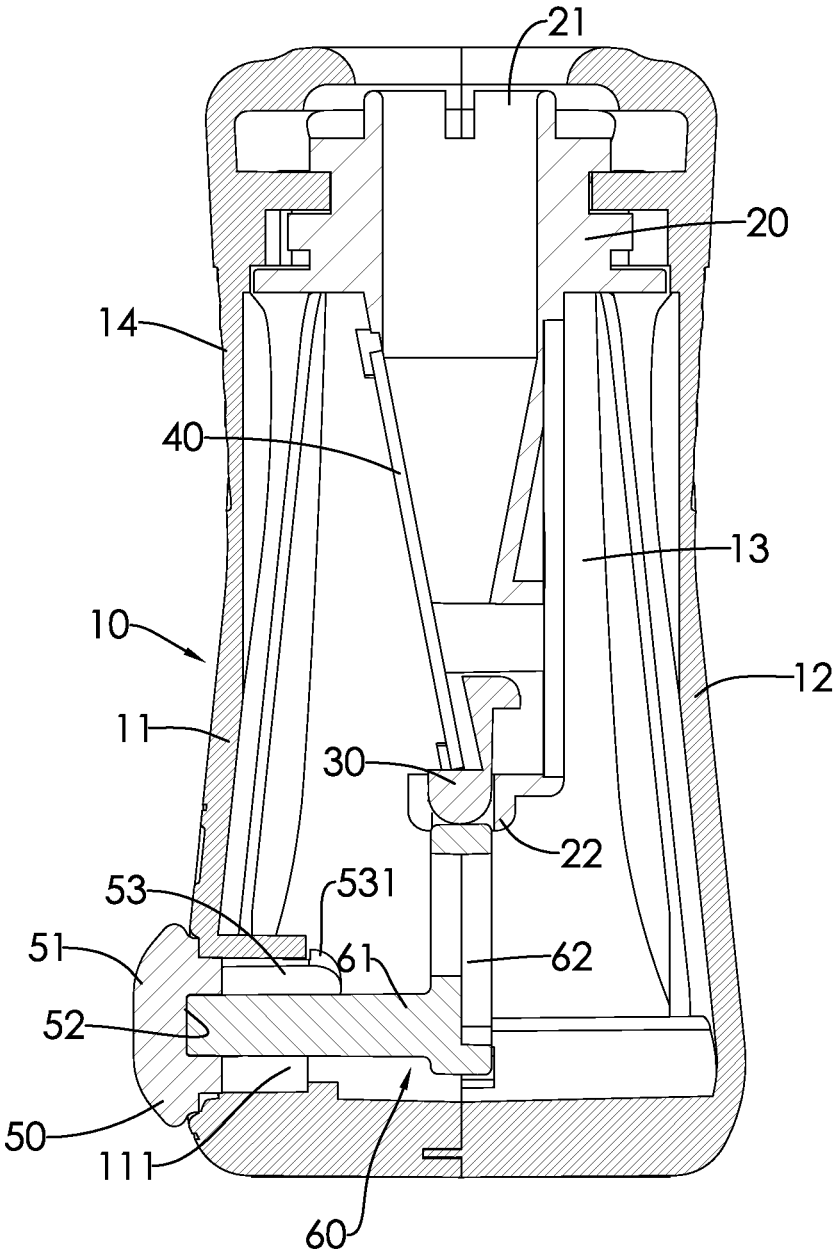
FIG. 4 is a side view in partial section of the pencil sharpener in FIG. 1.

The adjusting shaft 60 comprises a shaft body 61 and an adjusting wheel 62. The shaft body 61 has a non-circular cross section and two ends. One of the ends of the shaft body 61 is inserted into and securely engages the engaging recess 52 in the rotating knob 50, and the other end is connected with the adjusting wheel 62. The adjusting wheel 62 is disposed on the bottom of the blocking chunk 30 and has a periphery surface. With further reference to FIG. 2A, the periphery surface of the adjusting wheel 62 abuts the bottom of the blocking chunk 30, wherein radial distances R1, R2 from at least two positions on the periphery surface of the adjusting wheel 62 to an axial line L of the shaft body 61 are different from each other. When the rotating knob 50 is rotated, the adjusting shaft 60 is also rotated to push the blocking chunk 30 to move along the axial direction of the blade base 20 by the periphery surface of the adjusting wheel 62. Preferably, the periphery surface of the adjusting wheel 62 has a top segment and at least one side segment, and the radial distance R1 from the top segment to the axial line L of the shaft body 61 is longer than the radial distance R2 from the at least one side segment to the axial line L of the shaft body 61. In addition, the adjusting wheel 62 further has a limiting block 621 formed on and protruding from the bottom of the periphery surface of the adjusting wheel 62 and held in the limiting recess 122 in the rear casing 12 of the waste case 10.

As shown in the preferred embodiment, the waste case 10 has four positioning segments 112 formed on the inner wall of the mounting hole 111, and each positioning segment 112 is a cavity. Two indication members 113 are implemented on the outer surface of the waste case 10, and one indication member has a blunt tip shape and the other has a sharp tip shape. The rotating knob 50 has two connecting tabs 53, and the engaging segment 532 of each connecting tab 53 is a protrusion so the engaging segments 532 on the two connecting tabs 53 selectively engage two of the positioning segments 112 in the waste case 10. The top segment of the adjusting wheel 62 of the adjusting shaft 60 is a flat surface, and each one of the at least one side segment of the adjusting wheel 62 is a curved surface. The radial distance R1 from the flat surface to the axial line L of the shaft body 61 is longer than the radial distance R2 from each one of the at least one curved surface to the axial line L of the shaft body 61.

Figure 5:
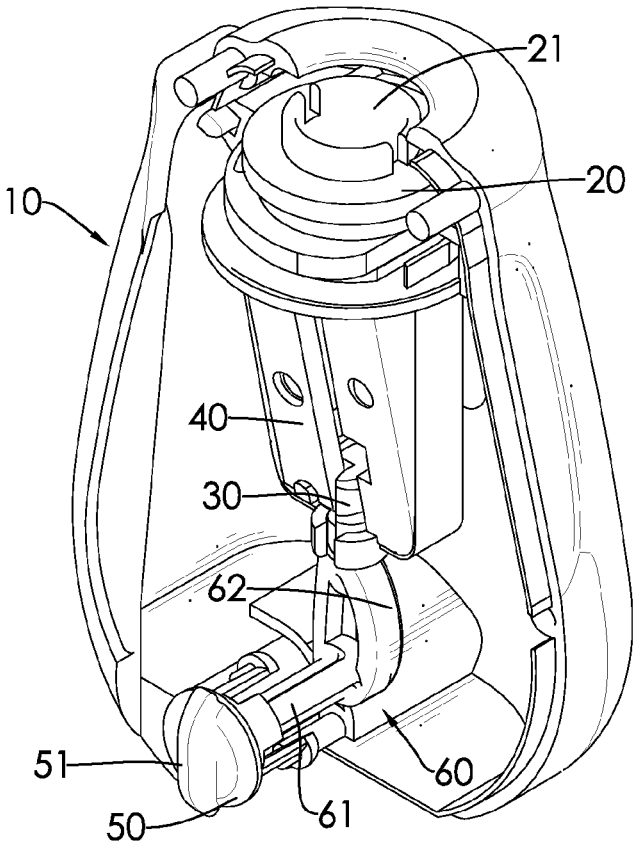
FIG. 5 is an operational perspective view of the pencil sharpener in FIG. 1 with the front casing removed and showing the pencil sharpener in a first operation stage.
Figure 6:
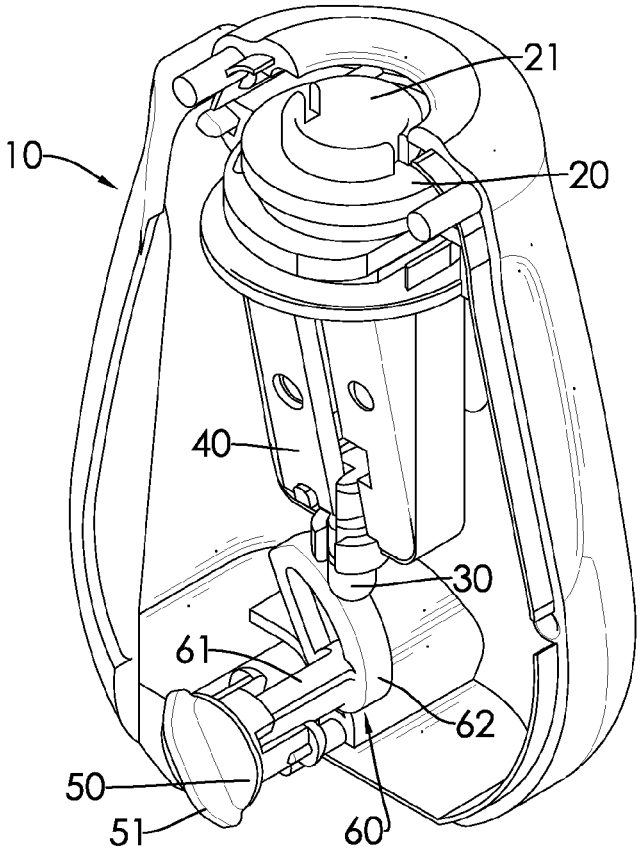
FIG. 6 is another operational perspective view of the pencil sharpener in FIG. 1 with the front casing removed and showing the pencil sharpener in a second operation stage.
Figure 7:
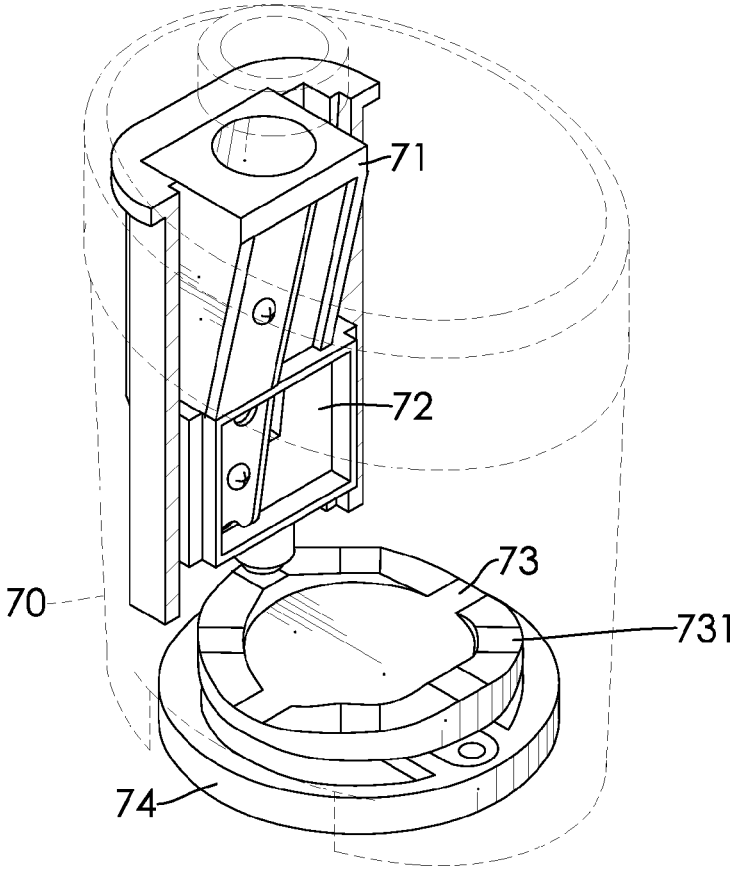
FIG.7 PRIOR ART
FIG. 7 is an operational perspective view of a pencil lead sharpener in Taiwan Utility Model No. M384109.

With such an arrangement, two operation stages are provided. Two different sharpening effects applied to a pencil tip can be rapidly shifted by rotating the rotating knob 50 according to the positions of the indication members 113. With reference to FIG. 5, when the rotating knob 50 is rotated to align the operating rib 51 with the indication member 113 having the blunt tip shape, the adjusting shaft 60 is rotated to enable the top segment having a long radial distance to abut and push the blocking chunk 30. Consequently, the blocking chunk 30 can be lifted and enter further into the pencil inserting hole 21 of the blade base 20. When a pencil is inserted into the pencil inserting hole 21 for sharpening, the tip of the pencil comes into abutment on the blocking chunk 30 sooner. Thus, the pencil will be less sharpened to form a blunt tip. With reference to FIG. 6, when the rotating knob 50 is rotated in reverse to align the operating rib 51 with the indication member 113 having the sharp tip shape, the adjusting shaft 60 is rotated to enable the side segment having a short radial distance to abut and push the blocking chunk 30. Consequently, the blocking chunk 30 is descended and moves away from the pencil inserting hole 21 of the blade base 20. When a pencil is inserted into the pencil inserting hole 21 for sharpening, the tip of the pencil will come into abutment on the blocking chunk 30 later. Thus, the pencil will be sharpened more to form a sharp tip.

When any one of the aforementioned adjusting processes is completed, the engaging segments 532 on the connecting tabs 53 of the rotating knob 50 will engage two of the positioning segments 112 in the waste case 10 to generate vibrations and sounds. Accordingly, the user can be noted that the adjusting process is completed and the pencil can be sharpened to a desired sharpness. In addition, with the limiting block 621 on the adjusting shaft 60 abutting between two end walls of the limiting recess 122 in the waste case 10, the rotation range of the rotating knob 50 can be limited.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pencil sharpener comprising:

a waste case having a mounting hole defined in the waste case and having an inner wall; and multiple positioning segments formed on the inner wall of the mounting hole;

a blade base mounted in the waste case and having a bottom;

a blocking chunk moveably mounted on the bottom of the blade base along an axial direction of the blade base and having a bottom;

a blade mounted securely on the blade base;

a rotating knob mounted rotatably in the mounting hole of the waste case and having a front side;

a rear side;

an operating rib formed on the front side of the rotating knob and exposed from an outer surface of the waste case; and at least one connecting tab formed on and protruding from the rear side of the rotating knob and mounted rotatably through the mounting hole in the waste case, and each one of the at least one connecting tab having an outer surface;

a holding block formed on one end of the connecting tab and engaging an edge of the mounting hole; and at least one engaging segment formed respectively on the outer surface of the at least one connecting tab, wherein each one of the at least one engaging segment selectively engages one of the positioning segments of the waste case; and an adjusting shaft connected securely with the rotating knob and disposed on the bottom of the blocking chunk, wherein when the rotating knob is rotated, the adjusting shaft is rotated to push the blocking chunk to move along the axial direction of the blade base.

2. The pencil sharpener as claimed in claim 1, wherein the adjusting shaft has a shaft body connected securely with the rotating knob; and an adjusting wheel connected securely with one end of the shaft body and having a periphery surface capable of pushing the blocking chunk to move, wherein radial distances from at least two positions on the periphery surface relative to the shaft body are different from each other.

3. The pencil sharpener as claimed in claim 2, wherein the waste case has a limiting recess defined in the waste case; and the adjusting wheel has a limiting block formed on and protruding from the periphery surface of the adjusting wheel and held in the limiting recess in the waste case.

4. The pencil sharpener as claimed in claim 3, wherein the blade base has a pencil inserting hole defined longitudinally through the blade base; and a limiting collar formed on and protruding from the bottom of the blade base and communicating with a bottom end of the pencil inserting hole; and the blocking chunk is mounted in the limiting collar.

5. The pencil sharpener as claimed in claim 4, wherein the limiting collar has a gap defined in the limiting collar; and the blocking chunk has a middle and two ends, and the middle has a diameter smaller than that of the ends to enable the middle of the blocking chunk to pass through the gap in the limiting collar.

6. The pencil sharpener as claimed in claim 4, wherein the waste case further has multiple indication members disposed on the outer surface of the waste case, arranged around the mounting hole and respectively having a shape corresponding to sharp or blunt tips; and the operating rib on the rotating knob selectively corresponds to one of the indication members on the waste case.

7. The pencil sharpener as claimed in claim 6, wherein the rotating knob has an engaging recess being non-circular in shape and formed in the rear side of the rotating knob; and the shaft body of the adjusting shaft has a non-circular cross section and is inserted into the engaging recess in the rotating knob.

8. The pencil sharpener as claimed in claim 7, wherein the waste case has a front casing and a rear casing combined with each other;

a side recess being elongated and defined at a conjunction between the front and rear casings in a side of the waste case;

a side opening defined at the conjunction between the front and rear casings in a side of the waste case opposite to the side recess; and a side cover pivotally connected to the front casing and the rear casing at a position near the side opening; and the mounting hole and the indication members are disposed on the front casing.

9. The pencil sharpener as claimed in claim 8, wherein each one of the front and rear casings has a skid-proof segment corresponding to each other in position.

10. The pencil sharpener as claimed in claim 1, wherein the waste case has four positioning segments; and the rotating knob has two engaging segments selectively engaging two of the positioning segments of the waste case.

11. The pencil sharpener as claimed in claim 10, wherein each positioning segment of the waste case is a cavity; and each engaging segment of the rotating knob is a protrusion.

12. The pencil sharpener as claimed in claim 6, wherein two indication members are implemented on the outer surface of the waste case, and one of the indication members has a blunt tip shape and the other indication member has a sharp tip shape.

13. The pencil sharpener as claimed in claim 1, wherein the waste case further has two indication members disposed on the outer surface of the waste case, and one of the indication members has a blunt tip shape and the other indication member has a sharp tip shape.

14. The pencil sharpener as claimed in claim 2, wherein the periphery surface of the adjusting wheel has a top segment and at least one side segment; and a radial distance from the top segment to an axial line of the shaft body is longer than that from each one of the at least one side segment to the axial line of the shaft body.

15. The pencil sharpener as claimed in claim 14, wherein the top segment of the adjusting wheel of the adjusting shaft is a flat surface, and each one of the at least one side segment of the adjusting wheel is a curved surface; and a radial distance from the flat surface to the axial line of the shaft body is longer than that from each one of the at least one curved surface to the axial line of the shaft body.

16. The pencil sharpener as claimed in claim 1, wherein each positioning segment of the waste case is a cavity; and each one of the at least one engaging segment of the rotating knob is a protrusion.

* * * * *